US005701571A

United States Patent [19]

Amamiya et al.

[11] Patent Number: 5,701,571

[45] Date of Patent: Dec. 23, 1997

[54] ELECTROPHOTOGRAPHIC APPARATUS, PROCESS CARTRIDGE, AND IMAGE FORMING METHOD FEATURING A PHOTOSENSITIVE MEMBER HAVING A CONDUCTIVE SURFACE LAYER AND A CLEANING MEANS HAVING CONDUCTIVE PROPERTIES

[75] Inventors: Syoji Amamiya, Kawasaki; Akio Maruyama; Yuichi Hashimoto, both of Tokyo, all of Japan

[73] Assignee: Canon Kabushiki Kaisha, Tokyo, Japan

[21] Appl. No.: 728,266

[22] Filed: Oct. 8, 1996

Related U.S. Application Data

[63] Continuation of Ser. No. 301,561, Sep. 7, 1994, abandoned.

[30] Foreign Application Priority Data

Sep. 10, 1993 [JP] Japan ..... 5-225854

[51] Int. Cl.[6] ..... G03G 21/00

[52] U.S. Cl. ..... 399/343; 399/351

[58] Field of Search ..... 399/343, 350, 399/351, 357, 159; 15/1.51, 256.5

[56] References Cited

U.S. PATENT DOCUMENTS

| | | | |
|---|---|---|---|
| 3,941,472 | 3/1976 | Nagahara et al. . | |
| 3,950,089 | 4/1976 | Fraser et al. . | |
| 4,482,244 | 11/1984 | Yamazaki et al. | 355/305 |
| 4,501,486 | 2/1985 | Landa | 355/299 |
| 4,502,780 | 3/1985 | Suzuki et al. | 355/305 |
| 4,530,596 | 7/1985 | Kawamoto et al. | 355/303 |
| 4,639,119 | 1/1987 | Isaka | 355/296 |
| 4,660,962 | 4/1987 | Maekawa et al. . | |
| 4,755,853 | 7/1988 | Shimizu et al. . | |
| 4,875,081 | 10/1989 | Goffe et al. | 355/303 |
| 5,105,221 | 4/1992 | Takahashi et al. | 355/210 |
| 5,130,755 | 7/1992 | Ikegawa et al. | 355/296 |
| 5,168,309 | 12/1992 | Adachi et al. | 355/219 |
| 5,381,219 | 1/1995 | Miskinis et al. | 355/305 |
| 5,385,796 | 1/1995 | Spiewak et al. | 430/64 |
| 5,385,797 | 1/1995 | Nagahara et al. | 355/211 X |

FOREIGN PATENT DOCUMENTS

0448780A1 10/1991 European Pat. Off. .

*Primary Examiner*—Sandra L. Brose

*Attorney, Agent, or Firm*—Fitzpatrick, Cella, Harper & Scinto

[57] ABSTRACT

An electrophotographic apparatus which includes an electrophotographic photosensitive member and a cleaning device, where the electrophotographic photosensitive member is provided with a surface layer having conductivity, and the cleaning device has conductivity where it touches the photosensitive member. The electrophotographic apparatus is excellent in cleaning residual toner.

36 Claims, 1 Drawing Sheet

ELECTROPHOTOGRAPHIC APPARATUS, PROCESS CARTRIDGE, AND IMAGE FORMING METHOD FEATURING A PHOTOSENSITIVE MEMBER HAVING A CONDUCTIVE SURFACE LAYER AND A CLEANING MEANS HAVING CONDUCTIVE PROPERTIES

This application is a continuation of application Ser. No. 08/301,561, filed Sep. 7, 1994, now abandoned.

BACKGROUND OF THE INVENTION

1. Field of the Invention

This invention relates to an electrophotographic apparatus such as a copying machine, a laser beam printer or a facsimile machine, a process cartridge used therein and an image forming method. More particularly, this invention relates to an electrophotographic apparatus having a specific electrophotographic photosensitive member and a specific cleaning means, a process cartridge having these, and an image forming method utilizing these.

2. Related Background Art

FIG. 2 schematically illustrates the constitution of a conventional electrophotographic apparatus. A process of image formation will be briefly explained with reference to this drawing.

In the apparatus, provided therein is an electrophotographic photosensitive member 21 supported to be rotatable in the direction of an arrow, on which an electrostatic latent image is formed to be developed into a visible image with a developer (or a toner). Around the photosensitive member, image forming means such as a primary charging means 22, an imagewise exposure means 23, a developing means 24, a transfer means 25, a cleaning means 27 and a pre-exposure means are provided.

First, the electrophotographic photosensitive member 21 is uniformly charged to a given potential by the primary charging means 22. Next, a color-separated optical image or a corresponding optical image is shed thereon through the imagewise exposure means 23 such as a laser beam exposure device to form on the electrophotographic photosensitive member 21 an electrostatic latent image faithful to the original. The electrostatic latent image thus formed is converted into a visible image by the developing means 24, and this visible image, i.e., a toner image, is transferred to a transfer medium P delivered through the transfer means 25. The transfer means 25 comprises a transfer corona assembly 25*a*, a residual charge eliminator 25*b*, and a transfer belt 25*c* to transport the transfer medium P fed from a paper feed device (not shown). As the transfer belt 25 is driven, the transfer medium P on the transfer belt 25*c* is brought into contact with the toner image formed on the periphery of the electrophotographic photosensitive member 21, and the toner image is transferred onto the transfer medium P by the operation of the transfer corona assembly 25*a*. Immediately thereafter, the charges accumulating on the transfer medium P are cancelled by the residual charge eliminator 25*b*. After the image transfer has been completed, the transfer medium P is further transported by the transfer belt 25*c*, then separated from the transfer belt 25*c*, and put out from the apparatus passing through a heat roller fixing means 26. Meanwhile, the residual toner on the electrophotographic photosensitive member 21 not transferred to the transfer medium P is removed by the cleaning means 27, and thereafter the surface of the electrophotographic photosensitive member 21 is made electrically uniform by the pre-exposure means. Then the electrophotographic photosensitive member 21 is ready for the next image forming process.

As the cleaning means for removing the residual toner after the image transfer process, there are two representative methods. One is to use a rubbery blade member, called a cleaning blade, which is brought into pressure contact with the surface of a photosensitive member without leaving any space between the photosensitive member to scrape the remaining toner off. The other method is to use a roller of a magnetic brush or a fur brush rotating in touch with the surface of the photosensitive member to scrape off or brush off the toner. Of these, the latter has a problem that the toner tends to escape or slip off, since it is difficult to press strongly the magnetic brush or a fur brush against the photosensitive member. Also, the photosensitive member may be damaged by melt-adhered toner accumulated on the fur brush. The rubber blade is cheeper than the fur brush and easy to design. Accordingly, cleaning means making use of a blade are popular at present.

When a wet toner is removed by using such a cleaning blade, there is no particular problem in respect of the friction between the photosensitive member surface and the blade, since the wet toner and a solvent thereof are fine particles and serve as a lubricant in the gaps between the blade and the photosensitive member surface. On the other hand, when a dry toner is removed by a cleaning blade, there is a problem that the friction between the photosensitive member surface and the blade may be so great that the cleaning blade tends to turn over. Since the dry toner serves as a good abrasive to the photosensitive member surface, the photosensitive member surface tends to become toughened and the lubricity between the photosensitive member surface and the cleaning blade will be improved along with their use. The surface of the photosensitive member, however, is not rough at the beginning of use and when the photosensitive member has a highly hard surface to improve the running performance, the surface is not toughened even after a prolonged use.

In order to solve this problem, various methods to improve the lubricity between the photosensitive member and the cleaning blade have been proposed and put into practice, for example, use of a lubricant applied to the cleaning blade, roughening of the surface of a photosensitive member from the beginning, and incorporation of a lubricant into the surface of a photosensitive member.

Employment of these methods has broadened the design latitude for the cleaning means in view of the blade turn-over problem, but then the problem of toner escape has emerged. At present, many attempts have been made to prevent the toner from escaping, such as the increased contact pressure of the cleaning blade or the use of an auxiliary means such as a cleaning brush or a cleaning roller in combination. However, a cleaning means in such a combination allows a very narrow latitude for their design, so that the tolerance for errors in mechanical design of the body or external environmental factors is extremely limited. In order to improve the image quality and running performance further, it is now required to ensure a higher safety against the occurrence of such troubles.

SUMMARY OF THE INVENTION

An object of the present invention is to provide an electrophotographic apparatus, a process cartridge and an image forming method that can enjoy a broad latitude for setting proper conditions for a cleaning means, and can stably and readily provide good images throughout repeated use, in environments of from low temperature and low humidity up to high temperature and high humidity.

The present invention provides an electrophotographic apparatus comprising an electrophotographic photosensitive member and a cleaning means; the electrophotographic photosensitive member being provided with a surface layer having conductivity, and the cleaning means having conductivity at the part which comes in contact with the photosensitive member.

The present invention also provides a process cartridge having such an electrophotographic photosensitive member and such a cleaning means, and an image forming method making use of these.

DESCRIPTION OF THE PREFERRED EMBODIMENTS

Figure 1:
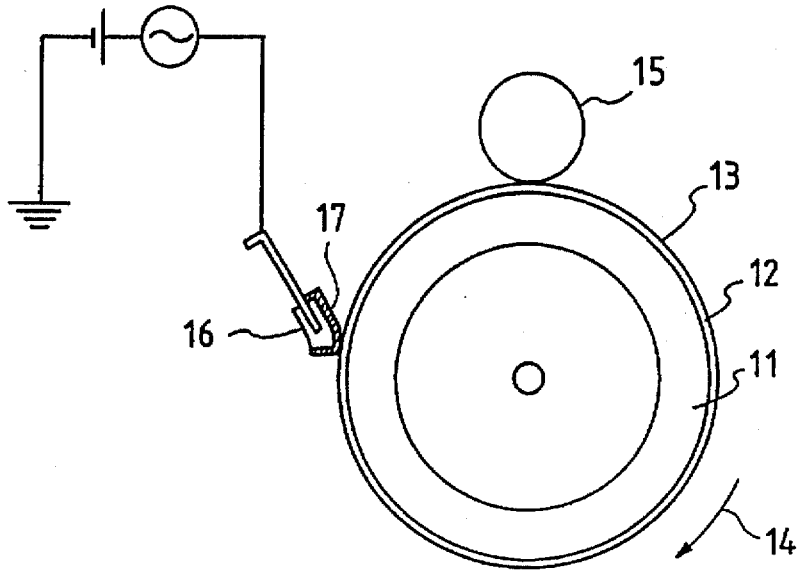
FIG. 1 schematically illustrates the constitution of the electrophotographic apparatus according to the present invention.
Figure 2:
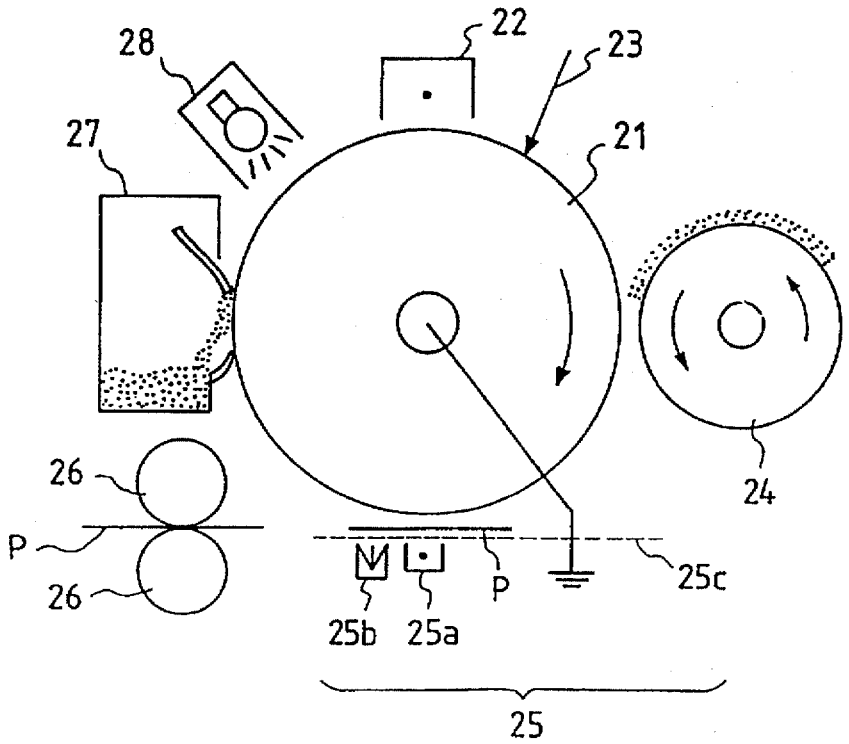
FIG. 2 PRIOR ART
FIG. 2 schematically illustrates the constitution of a conventional electrophotographic apparatus.

The electrophotographic apparatus and the process cartridge according to the present invention comprises i) an electrophotographic photosensitive member provided with a surface layer having conductivity and ii) a cleaning means having conductivity at the part which comes in contact with the photosensitive member.

In the electrophotographic process, the developer is electrostatically attracted to photosensitive member. Accordingly, the present inventors have made an experiment to reduce the electrostatic attraction by imparting conductivity to a cleaning means at the part touching the photosensitive member so that charges can be forcibly cancelled, and have obtained good results, although still unsatisfactory. More effective cancelling of the charges possessed by the photosensitive member and the developer was required for the further reduction of the electrostatic attraction between the photosensitive member and the developer. Then the present inventors have discovered that a great advantage can be obtained when the surface layer of the photosensitive member has electroconductivity properties, and the cleaning means has conductivity properties where it touches the photosensitive member.

The primary charging means used in the present invention may include corona charging, roller charging, brush charging and electrode charging. Once the electrophotographic photosensitive member used in the present invention is electrostatically charged by such charging means, charges are injected from the surface of the photosensitive member, and the charges are held in the vicinity of the interface between the surface layer having conductivity and a photosensitive layer. It is considered that the charges accumulating at this interface can readily move in the surface layer having conductivity and the charges are smoothly injected or moved from the surface layer to the cleaning means having conductivity properties where it touches the photosensitive member. As a result, it is considered that the potential of the surface of the photosensitive member and that of the cleaning means where they touch, become equal and hence the surface can be very efficiently cleaned. On the other hand, the charges present on the surface of a photosensitive member not provided with a conductive surface layer are difficult to be injected or moved into the cleaning means. The reason therefor is unclear.

As stated above and also as will become apparent from the results of Examples and Comparative Examples set out later, the remarkable effect of the present invention can be achieved for the first time by the combination of the photosensitive member with a surface layer having conductivity end the cleaning means to which conductivity properties has been imparted where it touches the photosensitive member are provided in combination.

The cleaning means used in the present invention may have any form of a blade, a brush, a roller or the like insofar as it is brought into contact with the surface layer of the photosensitive member at least at the time of operation, and has conductivity properties where it touches the surface layer of the photosensitive member. For the charges to be smoothly injected and moved, the part where the cleaning means comes into contact with the photosensitive member may preferably be broad. In this view point, the cleaning means may preferably be a brush. The brush may include a fur brush and what is a so-called magnetic brush in which magnetic particles having conductivity properties are arranged in the form of a brush by the action of a magnetic force. In the present invention, in view of durability, the cleaning means may particularly preferably be such a magnetic brush. On the other hand, in view of cost and simplicity, it may preferably be a blade.

As the materials to make the blade, the fur brush and the roller, there are metals such as iron and copper; conductive polymers such as polyacetylene and polypyrrole; insulating resins such as polycarbonate and polyester or rubbers with surface coating of a metal as set out above or of a conductive material such as conductive carbon black, or the resins and rubbers as set out above in which a metal as set out above or other conductive material has been dispersed. Of these, taking account of control of conductivity properties, resins or rubbers in which conductive materials have been dispersed are preferred. As the magnetic particles, particles of ferrite or magnetite are preferred.

The conductivity properties of the cleaning means used in the present invention may preferably be not higher than $10^{13}$ Ω.cm, and particularly preferably not higher than $10^{9}$ Ω.cm, in volume resistivity. If the volume resistivity is higher than $10^{13}$ Ω.cm, the injection and movement of the charges may become difficult, and the effect of the present invention may not be well achieved under certain environmental conditions. In the present invention, the volume resistivity is determined by applying voltage, at 25° C. and 50% RH, to a sample as it is or a sample molded into pellets.

Of the cleaning means, the part having conductivity properties is grounded, or a DC voltage, or a pulsating current voltage formed by superimposing a DC voltage and an AC voltage is externally applied thereto.

The electrophotographic photosensitive member used in the present invention comprises a photosensitive layer provided on a conductive support, and a surface layer having conductivity properties provided on the photosensitive layer.

The conductivity of the surface layer may preferably be not higher than $10^{15}$ Ω.cm, and particularly preferably from $10^{14}$ to $10^{10}$ Ω.cm, in volume resistivity. If the volume resistivity is higher than $10^{15}$ Ω.cm, the injection and movement of charges may become difficult, so that the effect of the present invention may not be fully displayed under certain environmental conditions. If it is lower than $10^{10}$ Ω.cm, the charge-holding ability of the photosensitive member tends to become lower, and according to the environmental conditions, electrostatic latent images faithful to originals may not be formed, resulting in blurred images.

The surface layer may preferably be a resin layer containing conductive particles dispersed therein, or a layer formed of an inorganic material such as SiC.

Such conductive particles may include metals such as aluminum, copper, nickel and silver; and metal oxides such as zinc oxide, titanium oxide, tin oxide, antimony oxide, indium oxide, bismuth oxide, tin-doped indium oxide, antimony-doped tin oxide, and zirconium oxide. These may each be used alone or in combination. The particles may preferably have a primary particle diameter of not larger than 0.3 μm in view of light transmission properties of the film.

The resin may be either a thermoplastic resin or a thermosetting resin, including polyurethane resins, epoxy resins, melamine resins, guanamine resins, polycarbonate resins, polyester resins, silicone resins, fluorine resins and polyacrylate resins.

The conductive particles dispersed in the surface layer may preferably be in a content of from 5 to 90% by weight, and particularly preferably from 10 to 90% by weight, based on the weight of all solid contents in the surface layer. If they are in a content less than 5% by weight, the resistivity may become too high. If in a content more than 90% by weight, the resistivity may become too low.

The electroconductive support and the photosensitive layer that are used in the present invention may be any known support and layer. When the surface layer is formed of SiC, the photosensitive layer may preferably be an amorphous silicon layer.

The electrophotographic photosensitive member having the conductive surface layer and the cleaning means having conductivity are essential components in the present invention, which can be joined as a process cartridge with other constituents such as the charging means and a developing means so that the process cartridge can be freely detachable from the main body of the electrophotographic apparatus such as a copying machine or a laser beam printer. For example, the photosensitive member and at least one of the charging means, the developing means and the cleaning means may be held into one cartridge together removable from the main body with a guide means such as rails provided in the body of the apparatus.

EXAMPLES

The present invention will be described below in greater detail by giving Examples.

Example 1

FIG. 1 schematically illustrates an example of the present invention.

An electrophotographic photosensitive member 13 having a photosensitive layer 11 and an electroconductive surface layer 12 provided thereon is rotated in the direction of an arrow 14 at an even speed. A charging roller 15 comes into contact with the photosensitive member 13, by which primary charging is carried out. The surface potential of the photosensitive member is −700 V and development is reversal mode. A cleaning blade 16 is coated with a resin 17 where it touches the photosensitive member. A bias voltage formed by superimposing AC voltage on DC voltage was externally applied to that part. Here, DC voltage $V_{DC}$ was −500 V, and peak-to-peak potential of AC voltage $V_{AC\text{-}PP}$ was 1,400 V (400 Hz).

The photosensitive member 13 was formed in the following way.

Using a sand mill grinder and glass beads of 1 mm diameter, 50 parts by weight of conductive titanium oxide powder whose particle surfaces had been coated with tin oxide containing 10% of antimony oxide, 25 parts by weight of phenol resin, 20 parts by weight of methyl cellosolve, 5 parts by weight of methanol and 0.002 part by weight of silicone oil (a polydimethylsiloxane-polyoxyalkylene copolymer; average molecular weight: 3,000) were dispersed for 2 hours to obtain a coating material to make the conductive layer. The coating material was applied to the surface of an aluminum cylinder of 80 mm diameter and 360 mm long by dipping, followed by drying at 140° C. for 30 minutes to form a conductive layer with a layer thickness of 20 μm.

Next, a solution prepared by dissolving 30 parts by weight of methoxymethylated nylon resin (number average molecular weight: 32,000) end 10 parts by weight of alcohol-soluble copolymer nylon resin (number average molecular weight: 29,000) in a mixed solvent of 260 parts by weight of methanol and 40 parts by weight of butanol was applied to the surface of the conductive layer by dipping, followed by drying to form a subbing layer with a layer thickness of 1 μm.

Next, 4 parts of a disazo pigment represented by the formula:

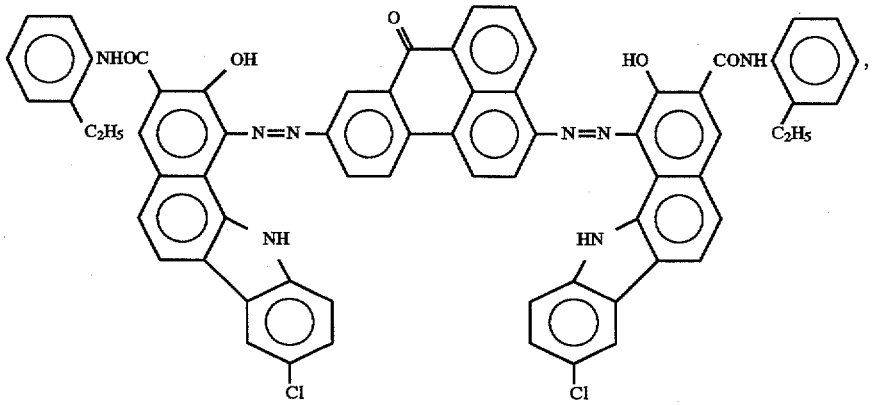

2 parts by weight of benzal resin and 40 parts by weight of tetrahydrofuran were dispersed for 60 hours using a sand mill grinder and glass beads of 1 mm diameter. Thereafter, the resulting dispersion was diluted with a mixed solvent of cyclohexanone and tetrahydrofuran to obtain a charge generation layer coating material. This coating material was applied to the surface of the subbing layer by dipping, followed by drying to form a charge generation layer with a layer thickness of 0.1 μm.

Next, 10 parts of a triarylamine compound represented by the formula:

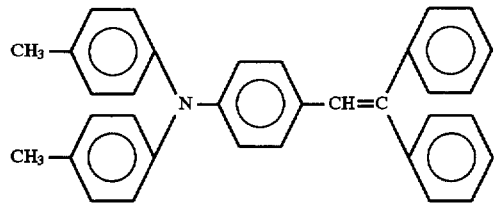

and 10 parts of polycarbonate resin (number average molecular weight: 25,000) were dissolved in a mixed solvent of 20 parts by weight of dichloromethane and 40 parts by weight of monochlorobenzene, and the resulting solution was applied to the surface of the above charge generation layer by dipping, followed by drying to form a charge transport layer with a layer thickness of 20 μm.

Next, 4 parts by weight of an acrylic resin monomer represented by the formula:

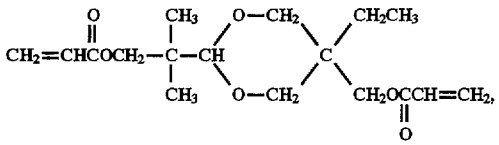

5 parts by weight of tin oxide (weight average particle diameter: 0.3 μm) and 1 parts by weight of a photopolymerization initiator were dissolved and dispersed in 30 parts by weight of ethanol, and the resulting solution was applied to the surface of the charge transport layer by dipping, followed by irradiation using a metal halide lamp (560 mW/cm$^2$, a luminance measured by a sensor having a central sensitivity at 360 nm) for 39 seconds to form a conductive surface layer with a layer thickness of 3 μm. This surface layer had a volume resistivity of $10^{12}$ Ω.cm.

The cleaning blade 16 having a conductive portion 17 where it touches the photosensitive member was produced in the manner as described below.

A solution prepared by dispersing 3 parts by weight of carbon black in a solution prepared by dissolving 7 parts by weight of a thermoplastic nylon resin in a solvent of 30 parts by weight of ethanol was applied to a urethane resin blade by dipping, followed by drying to obtain a cleaning blade having a conductive layer with a layer thickness of 10 μm. The volume resistivity of the conductive layer was $10^{-6}$ Ω.cm.

Using an electrophotographic apparatus having the electrophotographic photosensitive member and thus produced cleaning blade as shown in FIG. 1, running tests for 10,000 sheet image reproduction were made in environments of low temperature and low humidity (15° C., 10%RH) and high temperature and high humidity (30° C., 80%RH). Images obtained were visually evaluated.

As a result, in any environments, very good images were obtained without causing the problems of blade turn-over and toner escaping throughout the running.

Example 2

An electrophotographic photosensitive member was produced in the same manner as in Example 1 except that acrylic resin monomer was replaced with a silicone oil represented by the formula:

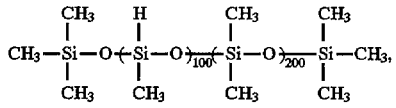

and in place of photopolymerization initiator and UV irradiation, the resin was cured by heating at 150° C. for two hours. The volume resistivity of the surface layer was $10^{11}$ Ω.cm.

Meanwhile, 10 parts by weight of tin oxide was melt-kneaded in 100 parts by weight of chloroprene rubber, and the resulting kneaded product was molded into a roller of 20 mm diameter and 340 mm long having a stainless steel shaft provided through the core. Thus, a cleaning roller was produced.

Using the above electrophotographic photosensitive member and a combination of the cleaning roller thus obtained and the same cleaning blade as in Example 1 as a cleaning means, running tests were made in the same manner as in Example 1. Here, the cleaning roller was provided upstream of the cleaning blade in the direction of the rotation of the photosensitive member, and its potential was dropped to the earth potential.

As a result, similar to Example 1, very good images were obtained without causing the problems of blade turn-over and remaining toner.

Example 3

An electrophotographic photosensitive member was produced in the same manner as in Example 1 except that acrylic resin monomer was replaced with a polyfunctional acrylic resin monomer represented by the formula:

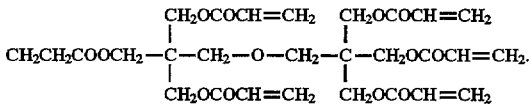

The volume resistivity of the surface layer was $10^{11}$ Ω.cm.

Using the electrophotographic photosensitive member thus obtained and a cleaning means making use of a conductive fur brush formed of carbon fibers made up into a bundle of 20 mm diameter and 360 mm long, running tests were made in the same manner as in Example 1. Here, a superimposed voltage of a DC voltage of $V_{DC}$=−300 V and an AC voltage with a peak-to-peak potential $V_{AC\text{-}PP}$ of 1,400 V (400 Hz) was applied to the brush.

As a result, similar to Example 1, very good images were obtained without the problems of blade turn-over and remaining toner.

Example 4

Running tests were made in the same manner as in Example 3 except that a magnetic brush was used as a cleaning means, in which magnetite particles of an average particle diameter of 20 μm had been provided in a brush formed around a magnet rod of 15 mm diameter. Here, the magnetite had a volume resistivity of $10^6$ Ω.cm, and the brush was in contact with the photosensitive member in a width of 5 mm and was rotated at 100 rpm in the direction opposite to the rotational direction of the photosensitive member under application of a DC current $V_{DC}$ of −600 V to the magnet rod.

As a result, similar to Example 1, very good images were obtained without causing the problems of blade turn-over and the remaining toner.

Comparative Example 1

A cleaning blade was produced in the same manner as in Example 1 except that no conductive layer was provided on the cleaning blade where it touches the photosensitive member. Here, the volume resistivity of the blade was $10^{16}$ Ω.cm.

Running tests were made in the same manner as in Example 1 except that the cleaning blade thus obtained was used.

As a result, faulty images caused by toner slip-off occurred upon image reproduction on 500 sheets in the environment of low temperature and low humidity.

Comparative Example 2

An electrophotographic photosensitive member was produced in the same manner as in Example 1 except that the electrophotographic photosensitive member was provided with no surface layer. Here, the surface of the electrophotographic photosensitive member had a volume resistivity of $10^{16}$ Ω.cm.

Running tests were made in the same manner as in Example 1 except that the electrophotographic photosensitive member thus obtained was used.

As a result, faulty images caused by remaining toner occurred upon image reproduction of 500 sheets in the environment of low temperature and low humidity.

What is claimed is:

1. An electrophotographic apparatus, comprising:

an electrophotographic photosensitive member having a conductive surface layer; and cleaning means for cleaning said electrophotographic photosensitive member and having a surface portion, with electroconductive particles dispersed therein, that contacts said electrophotographic photosensitive member.

2. An electrophotographic apparatus, according to claim 1, wherein said electrophotographic photosensitive member comprises a photosensitive layer provided on a conductive support, and said conductive surface layer.

3. An electrophotographic apparatus according to claim 1 or 2, wherein said surface layer comprises a resin in which conductive particles have been dispersed.

4. An electrophotographic apparatus according to claim 1 or 2, wherein the conductivity of said surface layer is not higher than $10^{15}$ Ω.cm in volume resistivity.

5. An electrophotographic apparatus according to claim 4, wherein said conductivity is from $10^{14}$ Ω.cm to $10^{10}$ Ω.cm in volume resistivity.

6. An electrophotographic apparatus according to claim 1 or 2, wherein said cleaning means comprises a cleaning member selected from the group consisting of a cleaning blade, a cleaning brush, and a cleaning roller.

7. An electrophotographic apparatus according to claim 6, wherein said cleaning member is a cleaning brush.

8. An electrophotographic apparatus according to claim 7, wherein said cleaning brush is a magnetic brush.

9. An electrophotographic apparatus according to claim 6, wherein said cleaning member is a cleaning blade.

10. An electrophotographic apparatus according to claim 1 or 2, wherein the conductivity of said cleaning means is not higher than $10^{13}$ Ω.cm in volume resistivity.

11. An electrophotographic apparatus according to claim 10, wherein said conductivity is not higher than $10^{9}$ Ω.cm in volume resistivity.

12. An electrophotographic apparatus according to claim 1, wherein a voltage is externally applied to said cleaning means.

13. A process cartridge comprising:

an electrophotographic photosensitive member having a conductive surface layer; and means selected from the group consisting of charging means for charging said electrophotographic photosensitive member, developing means for developing a latent image on said electrophotographic photosensitive member and having a toner feed member, and cleaning means for cleaning said electrophotographic photosensitive member and having a surface portion, with electroconductive particles dispersed therein, that contacts said electrophotographic photosensitive member, wherein said electrophotographic photosensitive member and said means selected from the group consisting of said charging means, said developing means, and said cleaning means constitute a unit that is freely mountable on or detachable from a main body of an electrophotographic apparatus.

14. A process cartridge according to claim 13, wherein said electrophotographic photosensitive member comprises a photosensitive layer provided on a conductive support, and said conductive surface layer.

15. A process cartridge according to claim 13 or 14, wherein said surface layer comprises a resin in which conductive particles have been dispersed.

16. A process cartridge according to claim 13 or 14, wherein the conductivity of said surface layer is not higher than $10^{15}$ Ω.cm in volume resistivity.

17. A process cartridge according to claim 16, wherein said conductivity is from $10^{14}$ Ω.cm to $10^{10}$ Ω.cm in volume resistivity.

18. A process cartridge according to claim 13 or 14, wherein said cleaning means comprises a cleaning member selected from the group consisting of a cleaning blade, a cleaning brush, and a cleaning roller.

19. A process cartridge according to claim 18, wherein said cleaning member is a cleaning brush.

20. A process cartridge according to claim 19, wherein said cleaning brush is a magnetic brush.

21. A process cartridge according to claim 18, wherein said cleaning member is a cleaning blade.

22. A process cartridge according to claim 13 or 14, wherein the conductivity said of cleaning means is not higher than $10^{13}$ Ω.cm in volume resistivity.

23. A process cartridge according to claim 22, wherein said conductivity is not higher than $10^{9}$ Ω.cm in volume resistivity.

24. A process cartridge according to claim 13, wherein a voltage is externally applied to said cleaning means.

25. An image forming method, comprising the step of:

removing developer remaining on an electroconductive surface layer of an electrophotographic photosensitive member using, cleaning means having a surface portion, with electroconductive particles dispersed therein, that contacts the electrophotographic photosensitive member.

26. An image forming method according to claim 25, wherein said electrophotographic photosensitive member comprises a photosensitive layer provided on a conductive support, and said electroconductive surface layer.

27. An image forming method according to claim 25 or 26, wherein said surface layer comprises a resin in which conductive particles have been dispersed.

28. An image forming method according to claim 25 or 26, wherein the conductivity of said surface layer is not higher than $10^{15}$ Ω.cm in volume resistivity.

29. An image forming method according to claim 28, wherein said conductivity is from $10^{14}$ Ω.cm to $10^{10}$ Ω.cm in volume resistivity.

30. An image forming method according to claim 25 or 26, wherein said cleaning means comprises a cleaning member selected from the group consisting of a cleaning blade, a cleaning brush, and a cleaning roller.

31. An image forming method according to claim 30, wherein said cleaning member is a cleaning brush.

32. An image forming method according to claim 31, wherein said cleaning brush is a magnetic brush.

33. An image forming method according to claim 30, wherein said cleaning member is a cleaning blade.

34. An image forming method according to claim 25 or 26, wherein the conductivity of said cleaning means is not higher than $10^{13}$ Ω.cm in volume resistivity.

35. An image forming method according to claim 34, wherein said conductivity is not higher than $10^{9}$ Ω.cm in volume resistivity.

36. An image forming method according to claim 25, wherein a voltage is externally applied to said cleaning means.

* * * * *

UNITED STATES PATENT AND TRADEMARK OFFICE

CERTIFICATE OF CORRECTION

PATENT NO. : 5,701,571

DATED : December 23, 1997

INVENTOR(S) : SYOJI AMAMIYA ET AL.

It is certified that error appears in the above-identified patent and that said Letters Patent is hereby corrected as shown below:

COLUMN 2

Line 37, "a" should be deleted.

COLUMN 4

Line 6, "end" should read --and--.

COLUMN 6

Line 7, "is" should read --is in--. (2nd occurrence)

Line 36, "end" should read --and--.

COLUMN 8

Line 42, "$10^{11}\Omega cm.$" should read --$10^{11}$ Ω cm.--.

UNITED STATES PATENT AND TRADEMARK OFFICE

CERTIFICATE OF CORRECTION

PATENT NO. : 5,701,571

DATED : December 23, 1997

INVENTOR(S) : SYOJI AMAMIYA ET AL.

It is certified that error appears in the above-identified patent and that said Letters Patent is hereby corrected as shown below:

COLUMN 10

Line 50, "said of" should read --of said--.

Signed and Sealed this

Thirtieth Day of June, 1998

*Attest:*

*Attesting Officer*

Bruce Lehman

BRUCE LEHMAN

*Commissioner of Patents and Trademarks*